US011612201B2

(12) United States Patent
Blackford et al.

(10) Patent No.: US 11,612,201 B2
(45) Date of Patent: Mar. 28, 2023

(54) LIMITED CONDUCTION HEAT REFLECTING MATERIALS

(71) Applicants: Michael "Woody" Blackford, Portland, OR (US); Jeffrey Thomas Mergy, Portland, OR (US)

(72) Inventors: Michael "Woody" Blackford, Portland, OR (US); Jeffrey Thomas Mergy, Portland, OR (US)

(73) Assignee: COLUMBIA SPORTSWEAR NORTH AMERICA, INC., Portland, OR (US)

( * ) Notice: Subject to any disclaimer, the term of this patent is extended or adjusted under 35 U.S.C. 154(b) by 309 days.

(21) Appl. No.: 16/162,035

(22) Filed: Oct. 16, 2018

(65) Prior Publication Data

US 2019/0110541 A1 Apr. 18, 2019

Related U.S. Application Data

(60) Provisional application No. 62/573,154, filed on Oct. 16, 2017.

(51) Int. Cl.
*A41D 31/06* (2019.01)
*A41D 27/02* (2006.01)
(Continued)

(52) U.S. Cl.
CPC ..... *A41D 31/065* (2019.02); *A41D 27/02* (2013.01); *A41D 31/02* (2013.01); *A41D 31/102* (2019.02);
(Continued)

(58) Field of Classification Search
CPC ..... A41D 31/065; A41D 27/02; A41D 31/02; A41D 31/145; A41D 2400/10;
(Continued)

(56) References Cited

U.S. PATENT DOCUMENTS

D92,994 S 5/1934 Aaronson
D107,621 S 12/1937 Stiglitz
(Continued)

FOREIGN PATENT DOCUMENTS

CN 103534405 B * 7/2015 ..... A41D 27/08
DE 9409799 4/1995
(Continued)

OTHER PUBLICATIONS

Sunmore, Poe Yoga Mat, Sporting Goods Buyers' Guide, Spring 2008.
(Continued)

*Primary Examiner* — Jennifer A Steele
(74) *Attorney, Agent, or Firm* — Schwabe, Williamson & Wyatt, P.C.

(57) ABSTRACT

Disclosed are insulating materials, and in particular materials that offer improved insulation properties without compromising breathability. The insulating materials may include a base material having a moisture vapor transfer rate (MVTR) of at least 2000 g/m$^2$/24 h (JIS 1099 A1); a plurality of heat-reflecting elements coupled to a first side of the base material, each heat-reflecting element having a heat-reflecting surface and being positioned to reflect heat towards an underlying surface; and a plurality of spacer elements coupled to the first side of the base material, each spacer element sized and shaped to reduce contact of the heat-reflecting elements with the underlying surface.

17 Claims, 7 Drawing Sheets

(51) Int. Cl.

| | |
|---|---|
| ***A41D 31/102*** | (2019.01) |
| ***D06N 7/00*** | (2006.01) |
| ***D06Q 1/00*** | (2006.01) |
| ***A41D 31/14*** | (2019.01) |
| ***A41D 31/02*** | (2019.01) |
| ***E04H 15/54*** | (2006.01) |
| ***A43B 1/00*** | (2006.01) |

(52) U.S. Cl.
CPC ..... *A43B 1/00* (2013.01); *D06N 7/0097* (2013.01); *D06Q 1/00* (2013.01); *E04H 15/54* (2013.01); *A41D 31/145* (2019.02); *A41D 2400/10* (2013.01); *A41D 2500/10* (2013.01); *A41D 2500/20* (2013.01); *A41D 2500/30* (2013.01); *D10B 2401/02* (2013.01); *D10B 2403/024* (2013.01); *D10B 2501/06* (2013.01); *Y10T 428/23907* (2015.04)

(58) Field of Classification Search
CPC ..... A41D 2400/22; A41D 2500/20; A41D 2500/30; A41D 2500/10; E04H 15/54; A43B 1/00; D10B 2501/06; D10B 2401/02; D10B 2403/024; Y10T 428/23907–23993; B32B 3/10; B32B 3/18
See application file for complete search history.

(56) References Cited

U.S. PATENT DOCUMENTS

D118,109 S 12/1939 Callahan
D119,351 S 5/1940 Katz
D129,870 S 10/1941 Maisch
D130,877 S 12/1941 Tips
2,471,008 A 4/1946 Pretty
D154,151 S 6/1949 Ryan
D158,550 S 5/1950 Brenerman
D169,305 S 4/1953 DeGrazia
2,695,895 A 11/1954 Barnard et al.
2,759,522 A 8/1956 Limm et al.
3,418,668 A 12/1968 Anderson
3,577,305 A 5/1971 Hines et al.
3,663,182 A 5/1972 Hamling
3,800,364 A 4/1974 Kalwaites
3,849,802 A 11/1974 Govaars
3,917,785 A 11/1975 Kalwaiets et al.
3,924,929 A 12/1975 Holmen et al.
3,934,065 A 1/1976 Tung
4,032,681 A * 6/1977 Jonnes ..... A41D 31/02 428/920
4,136,222 A * 1/1979 Jonnes ..... B29D 24/005 428/116
4,211,261 A 7/1980 Mehta et al.
4,395,455 A 7/1983 Frankosky
4,420,521 A 12/1983 Carr
4,435,442 A 3/1984 Hefele
4,463,464 A 8/1984 Bost et al.
4,483,021 A 11/1984 McCall
4,525,406 A 6/1985 Pollock
4,569,088 A 2/1986 Frankenburg et al.
4,569,874 A 2/1986 Kuznetz
4,622,253 A * 11/1986 Levy ..... A41D 31/04 428/91
4,637,949 A 1/1987 Maekawa et al.
4,712,609 A 12/1987 Iversen
4,765,323 A 8/1988 Poettgen
4,798,754 A 1/1989 Tomek
4,856,294 A 8/1989 Scaringe et al.
4,912,778 A 4/1990 Daniels
5,098,795 A 3/1992 Webb et al.
5,207,852 A 5/1993 Lightle et al.
5,366,785 A 11/1994 Sawdai
D358,734 S 5/1995 Paskwietz et al.
5,415,222 A 5/1995 Colvin
5,520,778 A 5/1996 Sawdai
D404,236 S 1/1999 Bergwall et al.
5,860,163 A 1/1999 Aldridge
D413,731 S 9/1999 Hannington
D414,252 S 9/1999 Orr
D414,642 S 10/1999 Williams
6,009,560 A 1/2000 McKenney et al.
6,031,665 A 2/2000 Carlson et al.
D428,293 S 7/2000 Williams
6,110,558 A 8/2000 Billingsley et al.
6,191,056 B1 2/2001 Vogt et al.
6,242,369 B1 6/2001 Vogt et al.
6,319,599 B1 11/2001 Buckley
6,321,386 B1 11/2001 Monica
6,341,384 B1 1/2002 Hayes
6,427,242 B1 8/2002 Bush et al.
6,511,929 B1 1/2003 Vogt et al.
D472,419 S 4/2003 Robbins, III
D477,743 S 7/2003 dePauw
6,589,631 B1 7/2003 Suzuki et al.
6,591,560 B2 7/2003 Burke, III et al.
D478,494 S 8/2003 Arnold
D478,761 S 8/2003 Robbins, III
D483,187 S 12/2003 Cheng
6,687,913 B2 2/2004 Aldridge
6,743,498 B2 6/2004 Fourmeux
D497,072 S 10/2004 Suero
6,811,852 B2 11/2004 Aiderman
6,824,819 B2 11/2004 Vogt et al.
6,855,410 B2 2/2005 Buckley
6,858,068 B2 2/2005 Smith et al.
6,874,336 B2 4/2005 Yarborough et al.
D508,180 S 8/2005 Sneed
6,934,985 B2 8/2005 Sanders
6,978,481 B2 12/2005 Mordecai et al.
D518,248 S 3/2006 Northrop
7,013,496 B2 3/2006 Dunn
7,226,879 B2 6/2007 Tilton et al.
D548,400 S 8/2007 Boord
D551,407 S 9/2007 Caruso et al.
7,399,919 B2 7/2008 McCutcheon et al.
7,452,833 B2 11/2008 Russell et al.
D583,569 S 12/2008 Claudat
D583,999 S 12/2008 Middlebrooks
7,465,484 B2 12/2008 Handwerker
D590,949 S 4/2009 Broyles
D596,860 S 7/2009 Doughty
D598,166 S 8/2009 Kemper
7,581,260 B2 9/2009 Underwood et al.
7,600,269 B2 10/2009 Feduzi et al.
D613,948 S 4/2010 Spritzer
7,739,749 B2 6/2010 Grilliot et al.
D628,005 S 11/2010 Chapman et al.
7,854,017 B2 12/2010 Laton
D630,442 S 1/2011 Sichel
D631,262 S 1/2011 Evans
D631,670 S 2/2011 Jackson
D637,008 S 5/2011 Frost
D638,224 S 5/2011 Ko et al.
8,424,119 B2 * 4/2013 Blackford ..... A43B 1/00 2/457
8,479,322 B2 * 7/2013 Blackford ..... A47G 9/086 2/457
8,510,871 B2 * 8/2013 Blackford ..... D06Q 1/00 2/457
8,918,919 B2 12/2014 Scholz
2002/0073481 A1 6/2002 Creagan et al.
2002/0166622 A1 11/2002 Weder
2003/0027476 A1 2/2003 Vogt et al.
2004/0128747 A1 7/2004 Bumbarger et al.
2004/0261465 A1 12/2004 Yarborough et al.
2005/0009429 A1 1/2005 Park et al.
2005/0077618 A1 4/2005 McCutcheon et al.
2005/0209663 A1 9/2005 Hamilton et al.
2005/0251900 A1 11/2005 Harlacker
2005/0252036 A1 11/2005 Laska
2006/0051559 A1 3/2006 Sleeman et al.
2006/0130367 A1 6/2006 Liu

(56) References Cited

U.S. PATENT DOCUMENTS

| | | | | |
|---|---|---|---|---|
| 2007/0037034 | A1 | 2/2007 | Fisher et al. | |
| 2007/0129767 | A1 | 6/2007 | Wahlstrand | |
| 2007/0267583 | A1 | 11/2007 | Dodo | |
| 2007/0267595 | A1 | 11/2007 | Dodo | |
| 2007/0277806 | A1 | 12/2007 | Dodo | |
| 2008/0030856 | A1 | 2/2008 | King | |
| 2008/0099188 | A1 | 5/2008 | Touzov | |
| 2008/0251062 | A1 | 10/2008 | Dodo | |
| 2008/0257333 | A1 | 10/2008 | Dodo et al. | |
| 2008/0282455 | A1 | 11/2008 | Jones et al. | |
| 2008/0283038 | A1 | 11/2008 | Dodo | |
| 2009/0000610 | A1 | 1/2009 | Dodo | |
| 2009/0007313 | A1 | 1/2009 | Boorsma et al. | |
| 2009/0209155 | A1 | 8/2009 | Goulet | |
| 2009/0258180 | A1 | 10/2009 | Goulet | |
| 2010/0020056 | A1 | 1/2010 | Le Roy et al. | |
| 2010/0071119 | A1 | 3/2010 | Thatcher | |
| 2010/0107657 | A1 | 5/2010 | Vistakula | |
| 2010/0138983 | A1 | 6/2010 | Kim | |
| 2010/0247855 | A1* | 9/2010 | Bletsos | B32B 27/40 428/137 |
| 2010/0282433 | A1 | 11/2010 | Blackford | |
| 2010/0326710 | A1 | 12/2010 | Zhang | |
| 2011/0020599 | A1 | 1/2011 | Le Roy et al. | |
| 2011/0036282 | A1 | 2/2011 | Cote | |
| 2011/0107771 | A1 | 5/2011 | Crist et al. | |
| 2011/0135899 | A1 | 6/2011 | Meltzer et al. | |
| 2011/0138523 | A1 | 6/2011 | Layson et al. | |
| 2011/0160691 | A1 | 6/2011 | Ng et al. | |
| 2011/0203783 | A1* | 8/2011 | Blackford | A41D 27/08 165/185 |
| 2011/0214221 | A1 | 9/2011 | Munda | |
| 2012/0015155 | A1* | 1/2012 | Blackford | A41D 31/12 428/189 |
| 2013/0042390 | A1* | 2/2013 | Blackford | A41D 31/12 2/243.1 |
| 2015/0104604 | A1* | 4/2015 | Rock | B32B 5/026 428/86 |
| 2015/0210032 | A1* | 7/2015 | Blackford | B32B 7/02 428/196 |
| 2015/0223533 | A1 | 8/2015 | Blakely et al. | |
| 2019/0008217 | A1 | 1/2019 | Cui et al. | |

FOREIGN PATENT DOCUMENTS

| | | |
|---|---|---|
| EP | 0917888 | 5/1999 |
| GB | 2073613 | 10/1981 |
| GB | 2294426 | 5/1996 |
| GB | 2414960 | 12/2005 |
| WO | 9749552 | 12/1997 |
| WO | 2002059414 | 8/2002 |
| WO | DM/064488 | 5/2003 |
| WO | DM/064044 | 7/2003 |
| WO | 2004/061035 | 7/2004 |
| WO | 2006030254 | 3/2006 |
| WO | DM/067876 | 5/2006 |
| WO | 2008/115143 | 9/2008 |
| WO | 2014120867 A1 | 7/2014 |
| WO | 2018/058062 | 3/2018 |

OTHER PUBLICATIONS

Castelli Insolito Radiation Jacket—3 Season Cycling Jacket; www.feedthehabit.com/road-biking/castelli-insolito-radiation-jacket-3-season-cycling-jacket/; Sep. 19, 2008.

Castelli Radiation Jacket; www.cyclingweekly.co.uk/archive/tech/322662/castelli-radiation-jacket-300.html; Mar. 10, 2009.

Notice for Reasons of Rejection filed in JP Patent Application No. 2020-519399, dated Nov. 25, 2022; 6 pages (including English translation).

* cited by examiner

LIMITED CONDUCTION HEAT REFLECTING MATERIALS

CROSS REFERENCE TO RELATED APPLICATION

This application claims the priority benefit of the earlier filing date of U.S. Provisional Application No. 62/573,154, filed Oct. 16, 2017, which is hereby incorporated herein by reference in its entirety.

TECHNICAL FIELD

Embodiments relate to heat reflecting materials, and in particular, to materials that offer improved heat reflective properties and limit heat conduction without compromising breathability.

BACKGROUND

Materials that provide improved insulation by reflecting body heat towards the body surface of a wearer often sacrifice moisture vapor transmission and result in low breathability. Such a reduction in moisture vapor transmission may cause the fabric to become damp, thereby causing discomfort and accelerating heat loss through heat conduction. Additionally, contact between heat-reflecting materials and the skin can undesirably allow the heat-reflecting materials to conduct body heat away from the skin, thus inadvertently accelerating heat loss.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
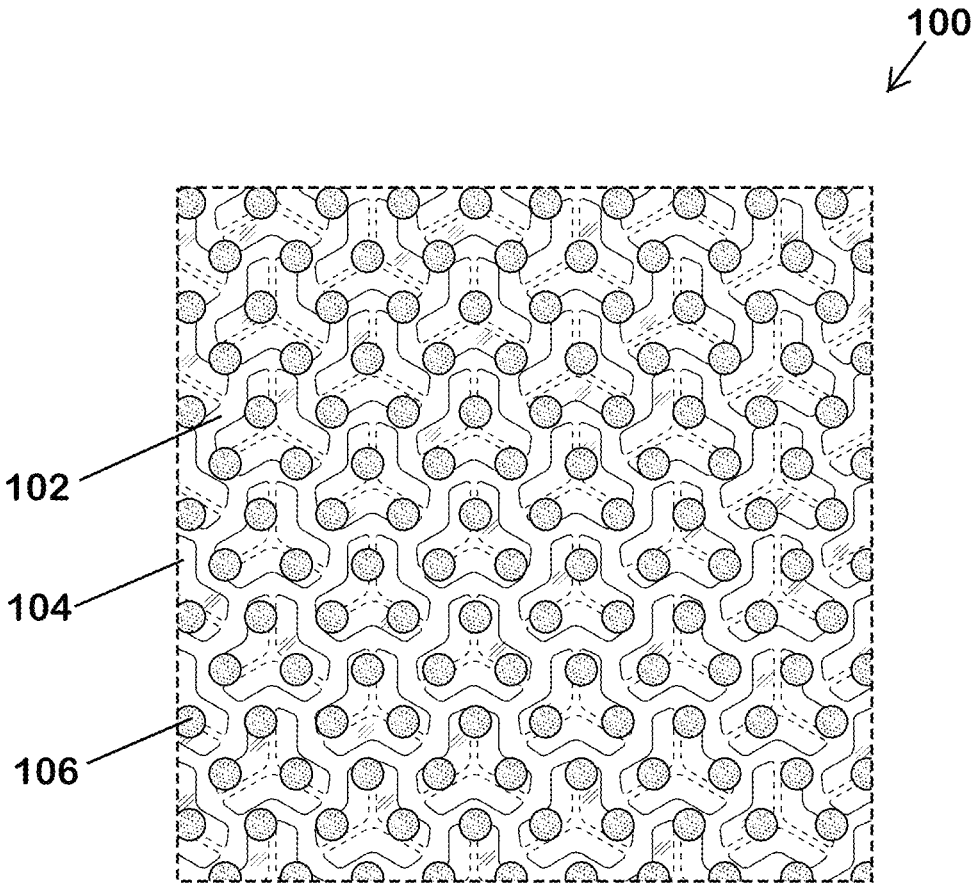
FIG. 1 illustrates a top view of one example of an insulating material, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments herein provide insulating materials, for example, for body gear and outdoor gear, that provide improved heat reflection and reduced heat conduction, while still providing excellent moisture vapor transmission.

In various embodiments, the insulating materials may include a base material, such as a fabric, having a moisture vapor transmission rate (MVTR) of at least 2000 $g/m^2/24$ h (JIS 1099 A1), such as at least 4000 $g/m^2/24$ h (JIS 1099 A1), at least 6000 $g/m^2/24$ h, or at least 8000 $g/m^2/24$ h. In various embodiments, the base material may be a mesh, foam, or leather. As used herein, the term "moisture vapor transmission rate (MVTR)" refers to a measure of the passage of water vapor through a material, such as a fabric. The term "breathable" is used herein to refer to a fabric that has an MVTR at or above 2000 $g/m^2/24$ h (JIS 1099 A1). In some embodiments, a breathable material allows for the passage of water vapor, but not liquid water. Although the term "breathable" is often assumed to also encompass air permeability, a "breathable" fabric does not necessarily have a high air permeability. Additional desirable characteristics of the base fabric may include water resistance, waterproofness, stretch, drape, and softness. In embodiments, a base material can be a woven or non-woven fabric, a knitted fabric, a foam, a mesh, a leather or other material used for the construction of an article of body gear and/or outdoor gear.

In various embodiments, a plurality of heat-reflecting elements may be coupled to a first side of the base material (for example, the side of the material that faces a user's body when the base fabric or other material is incorporated into body gear), and each heat-reflecting element may have a heat-reflecting surface and may be positioned to reflect heat towards a heat source, such as a user's body. Additionally, a plurality of spacer elements may be coupled to the first side of the base material. In various embodiments, each spacer element may maintain a space, such as an air space, between the first side of the base material, and may prevent or reduce contact between the heat-reflecting elements and an underlying surface, such as a base layer, intermediate layer of clothing, and/or a user's skin, thereby reducing heat conduction through the base material.

In various embodiments, each spacer element may project away from the first side of the base material at least 0.2-5.0 mm, such as about 0.2-2.0 mm. In various embodiments, the spacers may take any of a number of forms, and may in some examples be made from woven or non-woven pods, knitted material, foam elements, or vertically oriented fibers (VOF). In some embodiments, a spacer element made from vertically oriented fibers (e.g., a VOF element) may include a plurality of fibers that are oriented substantially perpendicular to the surface of the base material. In various embodiments, at least some of the plurality of spacer elements may at least partially overlay and/or overlap at least some of the plurality of heat-reflecting elements. In some embodiments, the spacer elements may completely overlap or partially overlap the heat-reflecting elements. In specific, non-limiting examples, the spacer elements may cover, overlay, or overlap about 2-40% of the surface area of the heat-reflecting elements, such as about 5-25%. In various embodiments, each spacer element may have a maximum dimension of about 1-6 mm, such as about 2-3 mm, and a center-to-center spacing of the spacer elements may be about 3-5 mm.

In various embodiments, the spacing and placement of both the heat-reflecting elements and the spacer elements may leave portions of the base material uncovered between adjacent elements, and these uncovered portions of the base material may provide moisture vapor transmission, resulting in a breathable material, such as a breathable fabric. In some embodiments, at least 15% of the base material may remain uncovered by both heat-reflecting elements and spacer elements, such as about 20%, about 30%, about 35%, or about 50%, In various embodiments, the heat-reflecting elements may cover a sufficient surface area of the base material to reflect a desired amount of heat, such as body heat, towards the body of a user, such as at least 30% of the base material.

In various embodiments, the spacer elements may provide enhanced insulation compared to base material alone. In various embodiments, the spacer elements may prevent or reduce contact between the heat-reflecting elements and an underlying surface, such as the surface of a base layer, or intermediate fabric or material layer, which may in turn reduce heat conduction by the heat-reflecting elements. Additionally, in various embodiments, the spacer elements may prevent or reduce contact between the heat-reflecting elements and the skin of a user, which may in turn reduce heat conduction by the heat-reflecting elements. In various embodiments, the spacer elements also may maintain space between the base material and an underlying surface, such as the surface of a base layer, or intermediate fabric or material layer, which may facilitate air flow and/or ventilation and enhance the sensation of breathability. In various embodiments, the spacer elements also may maintain space between the skin of a user and the base material, which may facilitate air flow and/or ventilation and enhance the sensation of breathability. Furthermore, the overlapping placement of the spacer elements and the heat-reflecting elements surprisingly does not reduce the amount of heat reflected by the heat-reflecting elements, or reduce the heat reflected as much as expected. In some embodiments, any loss of heat reflection may be more than offset by a corresponding decrease in heat conduction. In embodiments, a disclosed insulating material exhibits at least a 50% increase in insulation value over the base material from which it was constructed, for example at least 75%, at least 100%, at least 125%, at least 150%, at least 175%, at least 200%, at least 225% or even at least 250% greater insulation value over the value of the base material from which it was constructed, such as between about 50% and about 230% greater insulation value than the base material from which it was constructed, for example a material that does not include either heat-reflecting elements or spacer elements as described herein.

One of the most significant advantages of the disclosed materials is that the base material, such as base fabric, containing heat-reflecting elements and spacer elements, such as vertically oriented fiber elements, provides greater insulation than the base material alone by a surprising and unexpected amount. By adding the spacer elements and the heat-reflecting elements to the base material, heat is trapped and/or retained by the insulating material in a synergistic manner. As demonstrated in the Example below, and as specifically shown in Table 2, the inclusion of both spacer elements and the heat-reflecting elements to a base fabric has almost a two-fold increase over what would be expected from a simple linear addition of the effect of the spacer elements and the heat-reflecting elements alone. This synergistic effect provides for an insulating material that far exceeds expectations.

Figure 2:
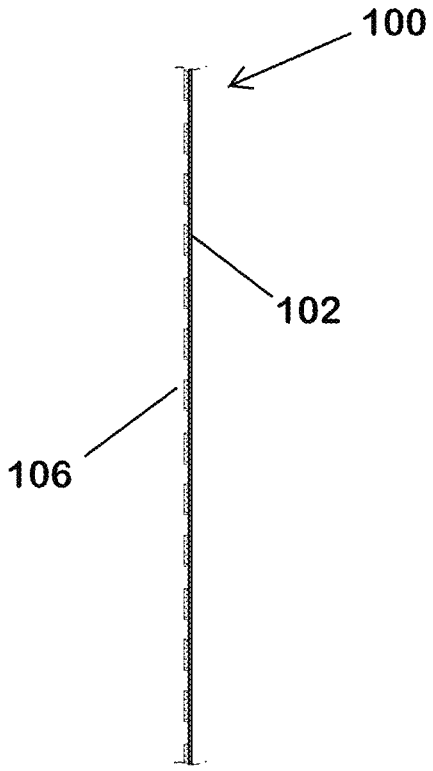
FIG. 2 illustrates a side view of the insulating material of FIG. 1, in accordance with various embodiments.
Figure 3:
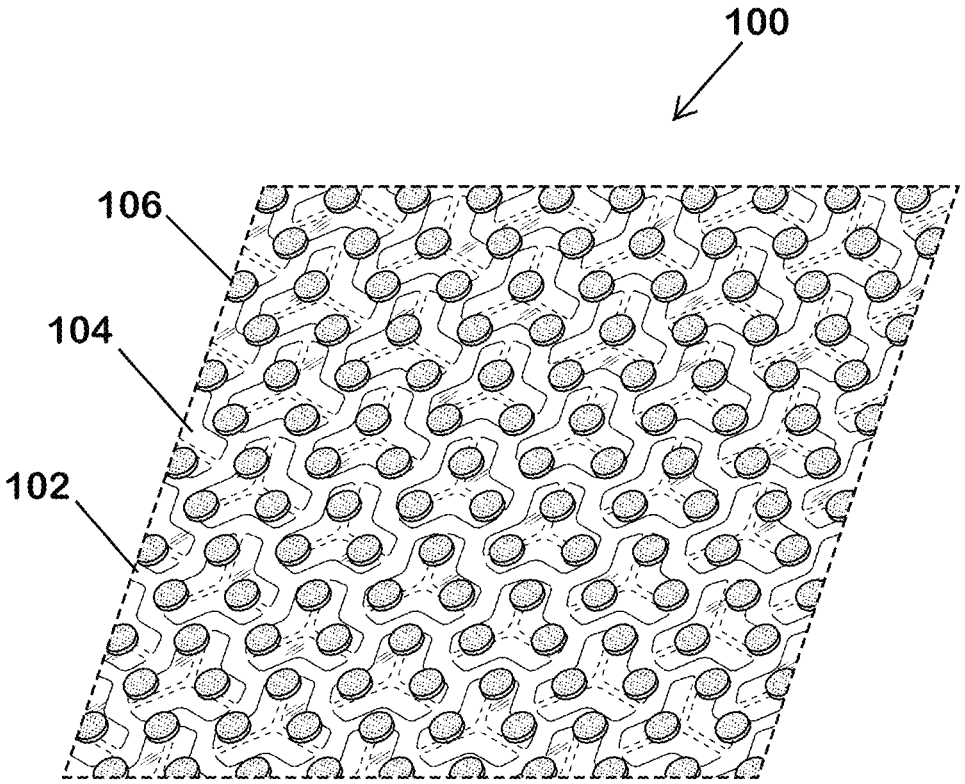
FIG. 3 illustrates a perspective view of the insulating material of FIG. 1, in accordance with various embodiments.

FIGS. 1, 2, and 3 illustrate a top view (FIG. 1), a side view (FIG. 2), and a perspective view (FIG. 3) of one example of an insulating material, in accordance with various embodiments. With reference to FIGS. 1, 2, and 3, the insulating fabric 100 may include a base material 102, such as a base fabric having an MVTR of at least 2000 $g/m^2/24$ h, which may allow moisture vapor to move away from the user's body and through the base material so as to prevent moisture build up inside the body gear. Additionally, the base material 102 may have one or more additional functional characteristics that are appropriate for its intended use. The base material 102 may be made from any material or materials that provides the desired set of functional characteristics, feel, weight, thickness, weave, texture, and/or other desired property, and may include nylon, polyester, rayon, cotton, spandex, wool, silk, or a blend thereof. In specific, non-limiting embodiments, the base material may be a "performance" material, such as a performance synthetic knit or woven material that has a high MVTR (for example, at least 2000 $g/m^2/24$ h, JIS1099 A1) and an air permeability of above 10-30 CFM on a Frazier device. In some embodiments, the first side of the base material may be flat for easier application of the heat-reflecting elements and/or spacer elements.

With continued reference to FIGS. 1, 2, and 3, the insulating material 100 also may include a plurality of heat-reflecting elements 104 coupled to a first side of the base material 102. As used herein, the term "first side" refers to the side of the base material 102 that is intended to face the user's body when the base material 102 is incorporated into body gear, whether that side contacts the user's body (such as when the insulating material 100 is used as the innermost or only layer in an article of body gear), or not (such as when the insulating material 100 is incorporated into the article of body gear as an intermediate or outermost layer). In various embodiments, each heat-reflecting element 104 may have a heat-reflecting surface and may be positioned to reflect heat towards the user's body.

As used herein, the term "heat-reflecting element" refers to a unitary element having a surface that reflects electromagnetic radiation having longer wavelengths than those of visible light (e.g., the infrared range, which extends from the nominal red edge of the visible spectrum at 700 nanometers (frequency 430 THz), to 1 mm (300 GHz) for the purpose of this disclosure). This range includes most of the thermal radiation emitted by objects near room temperature. In various embodiments, the heat-reflecting elements also may reflect electromagnetic radiation in other parts of the spectrum, such as the visible spectrum. In various embodiments, the heat-reflecting elements are formed from a metallic plastic or a foil, such as a film vacuum-metallized with aluminum. Various embodiments may include a film vacuum-metallized with aluminum which is coated with a thin lacquer. In various embodiments, the thin lacquer overcoat may contain pigments or dyes to modify the reflection of electromagnetic radiation in the visible range, thereby modifying the color of the reflective foil, while at the same time not significantly reducing the reflectance of electromagnetic radiation in the thermal IR range (5 to 35 microns). For example, the pigmented foil may be less than 1% lower thermal IR reflectance than the non-pigmented foil, less than 2% lower thermal IR reflectance than the non-pigmented foil, or less than 5% thermal IR reflectance than the non-pigmented foil. Generally, the heat-reflecting elements may include aluminum, silver, or any other heat-reflecting metal, or more generally, a low-emissivity heat reflective material. In particular embodiments, the heat reflecting elements may have an emissivity of no higher than 0.1, such as no higher than 0.08, no higher than 0.06, or no higher than 0.04.

In various embodiments, the heat-reflecting elements may cover 30-70% of the base material (e.g., the surface area ratio of heat-reflecting elements to base material may be from 7:3 to 3:7), such as 40-60% (e.g., a surface area coverage ratio of from 4:6 to 6:4). In various embodiments, the heat-reflecting elements may be coupled to the base material with an adhesive. In various embodiments, the heat-reflecting elements and/or spacer elements may be coupled to the base material with a glue or an adhesive, such as a urethane or acrylate-based adhesive. In some embodiments, the glue or adhesive may be adsorbent or absorbent, for example to aid in moving moisture outward from the body.

In various embodiments, the heat-reflecting elements may be applied in a pattern or a continuous or discontinuous array, such as a repeating or non-repeating pattern of separate, discrete elements (e.g., dots, rings, lines, stripes, waves, triangles, squares, stars, ovals, or other geometric patterns or shapes, or logos, words, etc.) or a repeating or non-repeating pattern of interconnected elements (such as a lattice). In various embodiments, a pattern of heat-reflecting elements may be symmetric, ordered, random, and/or asymmetrical. Further, the pattern, size, shape, or spacing of the heat-reflecting elements may differ at strategic locations in the body gear as dictated by the intended use of the article of body gear.

In various embodiments, the size of the heat-reflecting elements may be largest (or the spacing between them may be the smallest) in the core regions of the body for enhanced heat reflection in those areas, and the size of the heat-reflecting elements may be the smallest (or the spacing between them may be the largest) in peripheral areas of the body. In other embodiments, the size of the heat-reflecting elements may be smallest (or the spacing between them may be the largest) in the core regions of the body, and the size of the heat-reflecting elements may be the largest (or the spacing between them may be the smallest) in peripheral areas of the body for enhanced heat reflection in those areas. In some embodiments, the degree of coverage by the heat-reflecting elements may vary in a gradual fashion over the entire garment as needed for regional heat management. In some embodiments, reducing the area of individual elements, but increasing the density may provide a better balance between heat reflection and base material functionality. In some embodiments, the surface area of individual heat-reflecting elements may be less than 1 $cm^2$. In various embodiments, each heat-reflecting element may have a maximum dimension (diameter, hypotenuse, length, width, etc.) that is less than or equal to about 1 cm, such as 4 mm, or 1 mm.

With continued reference to FIGS. 1, 2, and 3, in certain specific, non-limiting examples, the insulating material also may include a plurality of vertically oriented fiber (VOF) elements 106 coupled to the first side of the base material 102, and each VOF element 106 may include a plurality of fibers that are oriented substantially perpendicular to the surface of the base material. As used herein, the term "VOF element" refers to a unitary element having a plurality of substantially perpendicular fibers. In various embodiments, the VOF elements may be discrete pods that contain a high density of vertically oriented fibers, such as at least 200 VOF fibers for a high denier, fairly coarse fiber. In various embodiments, the fibers may comprise nylon, polypropylene, or polyester. In various embodiments, the fibers may include nylon, rayon, polyester, and/or cotton fibers. The fibers may be wicking fibers in some embodiments. As defined herein, the term "wicking" refers to a fiber that allows transport of a fluid along its length, which for a VOF fiber means generally perpendicular to the plane of the base material. In various embodiments, the VOF elements and/or the individual fibers may be coupled to the base material with an adhesive. In other embodiments, the VOF fibers may be integrated into the material by embroidering, weaving, or knitting.

In various embodiments, the vertically oriented fibers may have an average length of 0.2-2.0 mm, such as about 0.6 mm, and an average linear density of 0.9-22 dtex, such as 1.7 dtex. In various embodiments, the fibers may be selected and arranged to maximize capillary forces between the fibers.

The VOF elements may be applied in a pattern or a continuous or discontinuous array, such as a repeating or non-repeating pattern of separate, discrete elements (e.g., dots, rings, lines, stripes, waves, triangles, squares, stars, ovals, or other geometric patterns or shapes, or logos, words, etc.) or a repeating or non-repeating pattern of interconnected elements (such as a lattice). In various embodiments, a pattern of VOF elements may be symmetric, ordered, random, and/or asymmetrical. Further, the pattern, size, shape, or spacing of the VOF elements may differ at strategic locations in the article, such as body gear, as dictated by the intended use of the article.

In various embodiments, at least a portion of the base material remains uncovered between adjacent heat-reflecting elements, and between adjacent VOF elements. Additionally, at least a portion of the base material may remain uncovered between both types of elements, such as at least 10-25%.

In various embodiments, the VOF elements may prevent or reduce contact between the heat reflecting elements and the underlying surface, such as a base layer or body surface. In various embodiments, the insulating material (including the base material, heat-reflecting elements, and VOF elements) may have a MVTR of at least 2000 g/m$^2$/24 h (JIS 1099 A1). The insulating material may form all or a part of any article, such as used as body or outdoor gear, for example a coat, jacket, shirt, shoe, boot, slipper, base layer, glove, mitten, hat, scarf, pants, sock, tent, backpack or sleeping bag. In certain embodiments the heat-reflecting elements and the spacer element are positioned on the innermost surface of an article, for example on the innermost surface of a base layer, such as the innermost surface of a base layer facing toward the skin of a subject.

Figure 4:
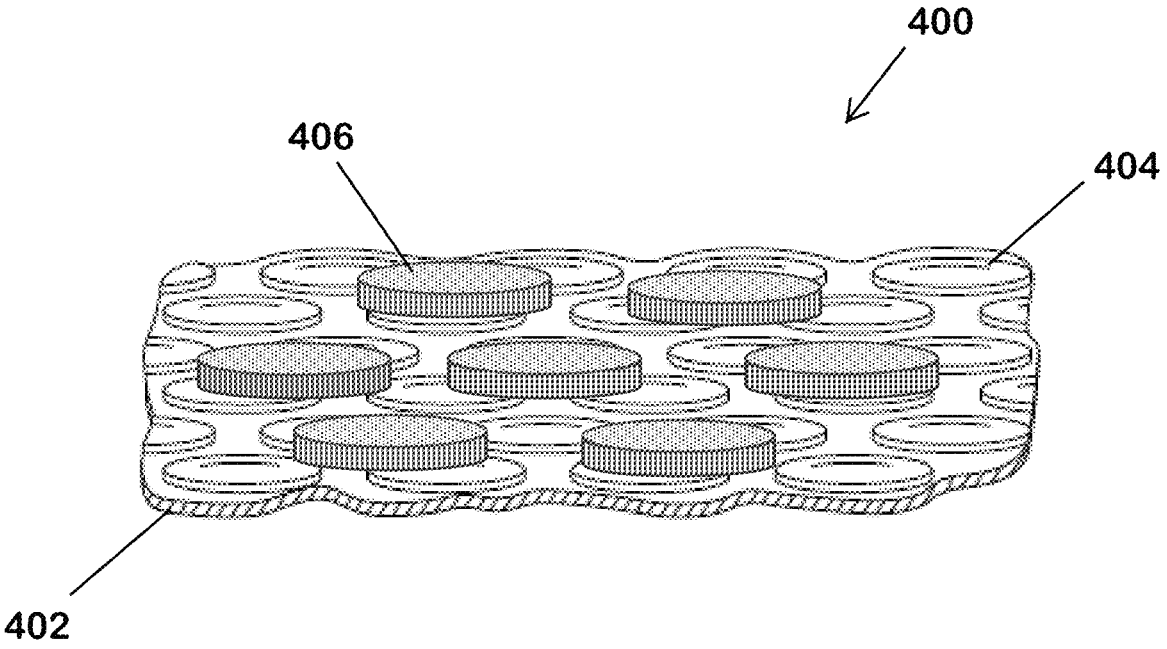
FIG. 4 illustrates a perspective view of a second example of an insulating material, in accordance with various embodiments.

FIG. 4 illustrates a perspective view of a second example of an insulating material 400, including a base material 402, a plurality of heat-reflecting elements 404, and a plurality of VOF elements 406, in accordance with various embodiments. As illustrated, in some embodiments at least a portion of the VOF elements 406 may overlap with and/or overlay at least a portion of the heat-reflecting elements 404.

Figure 5:
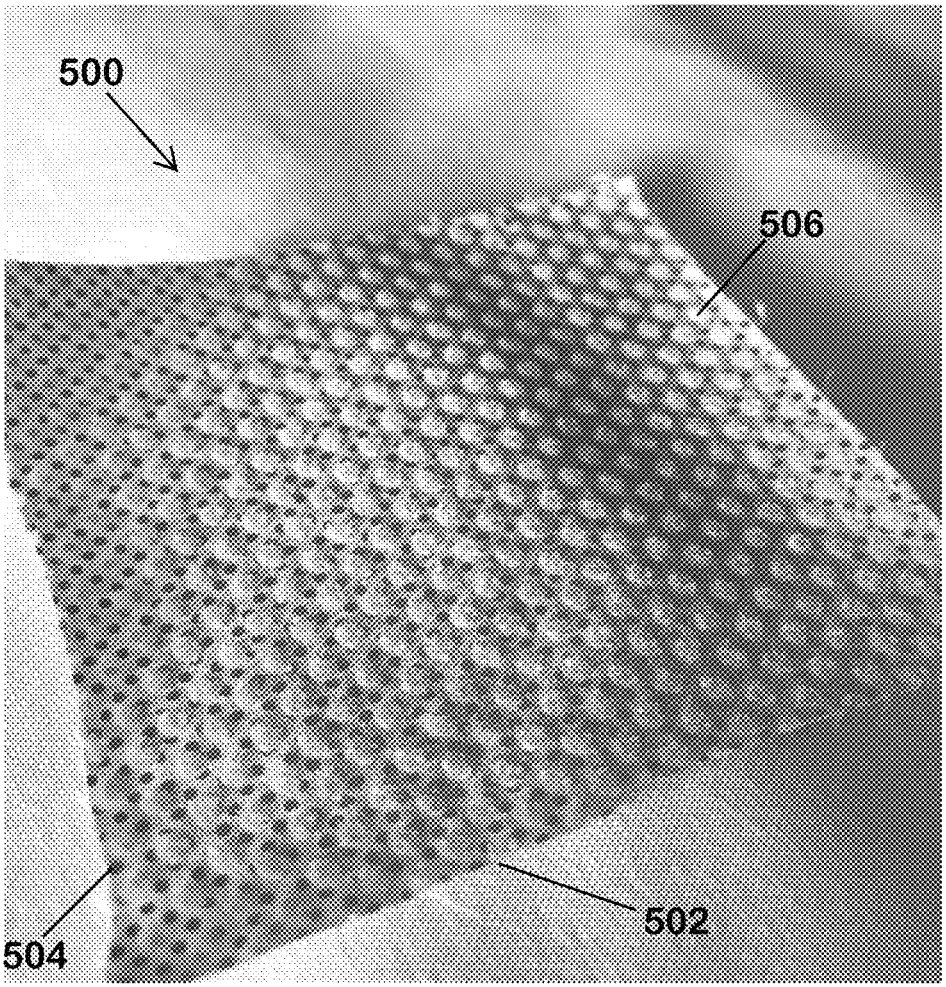
FIG. 5 is a digital image of a third example of an insulating material, in accordance with various embodiments.
Figure 6:
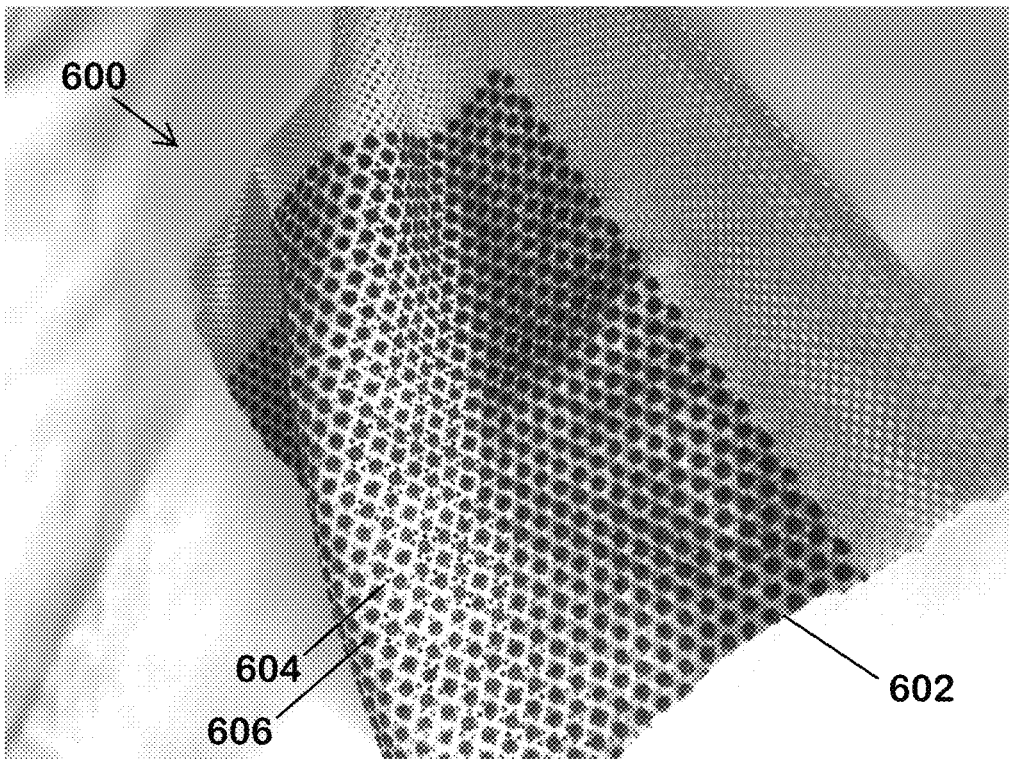
FIG. 6 is a digital image of a fourth example of an insulating material, in accordance with various embodiments.

FIG. 5 is a digital image of a third example of an insulating material 500, including a base material 502, a plurality of heat-reflecting elements 504, and a plurality of VOF elements 506; and FIG. 6 is a digital image of a fourth example of an insulating material 600, including a base material 602, a plurality of heat-reflecting elements 604, and a plurality of VOF elements 606, in accordance with various embodiments. In some embodiments, the VOF elements 606 may include dyed or pigmented fibers.

FIGS. 7A, 7B, 7C, and 7D are heat escape maps measured with an IR thermal imaging camera, for base material with VOF elements (FIG. 7A), base material alone (FIG. 7B), base material with heat-reflecting elements (FIG. 7C), and base material with heat-reflecting elements and VOF elements (FIG. 7D), in accordance with various embodiments. These images were measured on circular material samples (approx. 6.9-cm-diameter) placed face down on an insulated hot plate assembly using a FLIR SC83000 HD Series high speed MWIR megapixel infrared camera. The insulated hot plate assembly consisted of a 0.125" thick 6061 aluminum alloy plate as the test surface, which was placed on top of a silicone resistive heating pad (McMaster-Carr p/n 35765K708), which was on top of 2" thick cork insulation. The test surface plate had slots cut into it in a rectangular shape to produce a uniform temperature on the test surface. The test surface was also painted matte black to approximate the emissivity of skin ($\varepsilon_{skin}$=0.95≈$\varepsilon_{black\ paint\ (Parsons)}$=0.98). A variable transformer was adjusted to provide a steady-state surface temperature. (See, e.g., Incropera, F., DeWitt, D., Bergman, T., and Lavine, A., *Fundamentals of Heat and Mass Transfer,* 6$^{th}$ Edition, John Wiley & Sons, 2007.)

Also disclosed in various embodiments are methods of making an insulating material, which methods generally include coupling a plurality of heat-reflecting elements to a first side of a base material having a moisture vapor transfer rate (MVTR) of at least 2000 g/m$^2$/24 h (JIS 1099 A1), each of the heat-reflecting elements having a heat-reflecting surface; and coupling a plurality of vertically oriented fiber (VOF) elements to the first side of the base material such that at least some of the plurality of VOF elements at least partially overlay at least some of the plurality of heat-reflecting elements. Each VOF element includes a plurality of fibers oriented substantially perpendicular to a surface of the base material.

In various embodiments, the heat-reflecting elements are coupled to the base material before the VOF elements are coupled to the base material. The heat-reflecting elements may be permanently coupled to the base material in a variety of ways, including, but not limited to laminating, gluing, heat pressing, printing, or welding, such as by hot air, radiofrequency or ultrasonic welding.

In various embodiments, the plurality of VOF elements may then be coupled to the first side of the base material by screen printing an adhesive followed by electrostatic deposition of short fibers. Other methods to add VOF elements include embroidering, weaving and knitting. For instance, in some embodiments, an adhesive, such as a single part or two-part catalyzed adhesive may be used to couple the VOF elements to the base material. The adhesive may be applied to the base material in a desired pattern using a printing process, and the fibers may then be deposited electrostatically on the base material. Un-adhered fibers may then be removed from the base material by vacuum.

In one specific, non-limiting example, the fibers may be dispensed from a hopper through a positive electrode grid, which may orient the fibers and accelerate them towards the base material surface. A grounded electrode may be positioned under the material surface, and the fibers may be vertically embedded in the adhesive in the areas in which it was applied to the base material, creating a plurality of VOF elements.

In another specific, non-limiting example, the adhesive may instead be applied to a transfer membrane, and the fibers may be electrostatically embedded in the adhesive on the transfer membrane, creating a plurality of VOF elements. The transfer membrane may then be used to apply the VOF elements to the base material.

Examples

In various embodiments, the insulating materials described herein may have superior insulating characteristics as compared to other insulating materials, including materials that include heat-reflecting materials without VOF elements. As shown in Table 1 below, four different base materials were tested using standard hot plate testing. Samples of the four different base materials were tested in three different configurations: no heat reflecting or VOF elements ("Fabric"), heat-reflecting elements only ("Fabric+heat-reflecting element"), and with both heat-reflecting and VOF elements ("Fabric+heat-reflecting element+vertically oriented fiber"). Heat flux (W) and dry heat transfer rate (W/m$^{2\circ}$ C.)) were measured, and an average insulation value (clo=0.155 K·m$^2$·W$^{-1}$) was calculated for each. As used herein, the term "heat" refers to thermal energy transported due to a temperature gradient (J or Cal). As used herein, the term "heat rate" refers to thermal energy transported per unit time (J/s=W). As used herein, the term "heat flux" refers to heat rate per unit area. As used herein, the term "thermal transmittance" refers to heat flux per unit temperature gradient (W/m$^2$·K). As used herein, the term "thermal resistance" refers to the reciprocal of thermal transmittance (m$^2$·K/W) and clo, which is 0.155 m$^2$·K/W, is a unit of measure for insulation value. The results of testing of specific examples of limited conduction heat reflective materials is shown below in Table 1.

TABLE 1

Thermal Resistance Data Measured Using Standard Hotplate Testing

| | Fabric | Fabric + heat-reflecting element | Fabric + heat-reflecting element + vertically oriented fiber |
|---|---|---|---|
| Base fabric 053165 | | | |
| Total thermal resistance, $R_{ct}$ (clo)[1] | 0.423 ± 0.003 | 0.403 ± 0.003 | 0.467 ± 0.003 |
| Thermal resistance of the fabric alone, $R_{cf}$ (clo) | 0.068 ± 0.004 | 0.048 ± 0.003 | 0.112 ± 0.009 |
| Base fabric 033770 | | | |
| Total thermal resistance, $R_{ct}$ (clo)[1] | 0.478 ± 0.010 | 0.425 ± 0.015 | 0.484 ± 0.008 |
| Thermal resistance of the fabric alone, $R_{cf}$ (clo) | 0.123 ± 0.011 | 0.070 ± 0.015 | 0.129 ± 0.008 |
| Base fabric 031908 | | | |
| Total thermal resistance, $R_{ct}$ (clo)[1] | 0.387 ± 0.013 | 0.376 ± 0.007 | 0.455 ± 0.011 |
| Thermal resistance of the fabric alone, $R_{cf}$ (clo) | 0.032 ± 0.013 | 0.021 ± 0.007 | 0.100 ± 0.011 |
| Base fabric 060360 | | | |
| Total thermal resistance, $R_{ct}$ (clo)[2] | 0.560 ± 0.033 | 0.559 ± 0.007 | 0.668 ± 0.015 |
| Thermal resistance of the fabric alone, $R_{cf}$ (clo) | 0.047 | 0.046 | 0.155 |

[1]Bare plate thermal resistance, $R_{cbp}$ (clo) = 0.353 ± 0.002
[2]Bare plate thermal resistance, $R_{cbp}$ (clo) = 0.514 (no standard deviation provided)

Dry heat transport data were measured in general accordance with ASTM F1868, Part A—Thermal Resistance. Tests were conducted on 4 different base fabrics, the same fabrics with heat-reflecting elements, and the same materials with heat-reflecting elements plus vertically oriented fiber. The results are shown in Table 1 as the total thermal resistance, $R_{ct}$, and the thermal resistance of the fabric alone, $R_{cf}$. These values are given in clo units, and are also known as insulation values. In all cases, the insulation values are lower for the fabric+heat-reflecting element as compared to the same base fabric. When spacer elements (in this case, vertically oriented fiber elements) are added, however, the insulation values were greater than they are for the base fabric and for the fabric+heat-reflecting element by a substantial amount. Depending on the specific base material, insulation values of the disclosed insulating materials typically exhibit from 50% to 230% greater insulation values than the base materials from which they were constructed.

TABLE 2

Area-averaged Temperature from Heat Escape Maps

| Material | Average Backside Surface Temperature (° C.) | Temperature Difference from Base Material (° C.) |
|---|---|---|
| Fabric ("Base") | 33.4 | — |
| Fabric + vertically oriented fiber ("VOF only") | 32.5 | 0.9 |
| Fabric + heat-reflecting elements ("OHR only") | 32.3 | 1.1 |

TABLE 2-continued

Area-averaged Temperature from Heat Escape Maps

| Material | Average Backside Surface Temperature (° C.) | Temperature Difference from Base Material (° C.) |
|---|---|---|
| Fabric + heat-reflecting element + vertically oriented fiber ("OH3D") | 29.7 | 3.7 |

Figures 7A, 7B, 7C, 7D:
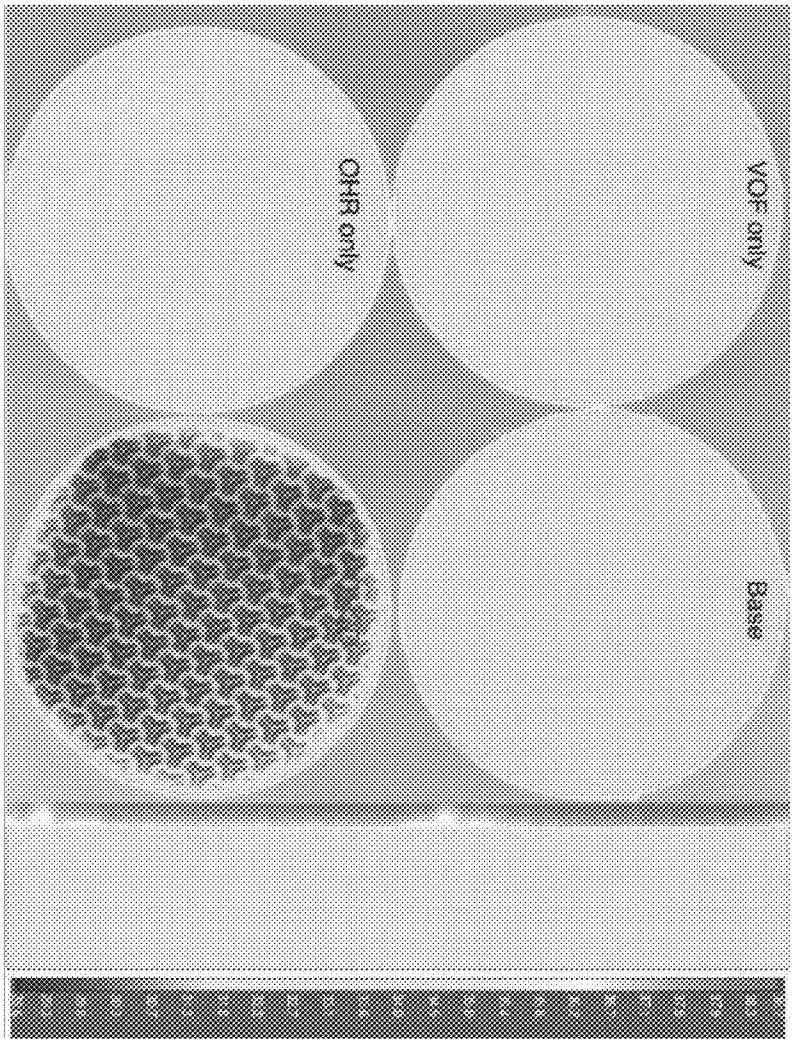
FIGS. 7A, 7B, 7C, and 7D are heat escape maps measured with an infrared (IR) thermal imaging camera, for base fabric with vertically oriented fiber (VOF) elements (FIG. 7A), base fabric alone (FIG. 7B), base fabric with heat-reflecting elements (FIG. 7C), and base fabric with heat-reflecting elements and VOF elements (FIG. 7D), in accordance with various embodiments.

FIGS. 7A, 7B, 7C, and 7B show heat escape maps measured with an IR thermal imaging camera, for base fabric with VOF elements (FIG. 7A), base fabric alone (FIG. 7B), base fabric with heat-reflecting elements (FIG. 7C), and base fabric with heat-reflecting elements and VOF elements (FIG. 7D), in accordance with various embodiments. The circular samples were placed face down on an insulated hot plate assembly set at approximately 37° C. The thermal images were taken of the backside of each of the fabric samples. Thus, for the fabric samples that contain VOF, heat-reflecting elements, or both, these features face toward the hot plate and therefore cannot affect the sample emissivity toward the infrared camera. As a result, the measured signal is an accurate measure of the temperature of the backside of each fabric, and representative of the amount of heat that escapes through the fabric.

Area-averaged temperatures from the heat escape maps of FIG. 7 are shown in Table 2. The highest average temperature, and the temperature closest to the temperature of the hot plate, is 33.4° C. for the base fabric. Thus, the most heat escapes through the base fabric, which is the least insulating of the four fabrics measured. The next highest average temperature is 32.5° C. for the base fabric+vertically oriented fiber ("VOF only"), followed by 32.3° C. for the base fabric+heat-reflecting elements ("OHR only"). The lowest average temperature is 29.7° C. for the base fabric+heat-reflecting elements+vertically oriented fiber ("OH3D"). Thus, the least amount of heat escapes through this fabric, which is the most insulating of the four fabrics measured.

Most significantly, the base fabric containing heat-reflecting elements+vertically oriented fiber is more insulating than the base fabric by a surprising and unexpected amount. By adding vertically oriented fiber to the base fabric, sufficient heat is trapped to lower the backside average temperature by 0.9° C. (see Table 2). By adding heat-reflecting elements to the base fabric, sufficient heat is trapped to lower the backside average temperature by 1.1° C. By adding both elements to the base fabric, one might expect the combined effect would lead to a lower temperature of around 2° C. (0.9° C.+1.1° C.), or even less since the elements overlap. However, the combined effect is nearly twice this amount. The combined effect of VOF and heat-reflecting elements traps enough heat to lower the backside average temperature by 3.7° C.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. An insulating material comprising:

a base material having a moisture vapor transfer rate (MVTR) of at least 2000 g/m$^2$/24 h (JIS 1099 A1);

a plurality of heat-reflecting elements coupled onto a first side of the base material, wherein the first side of the base material is an innermost surface of the base material, each heat-reflecting element having a heat-reflecting surface positioned to reflect heat towards a wearer of the insulating material; and a plurality of spacer elements comprising vertically oriented fiber (VOF) elements, wherein at least some of the plurality of spacer elements at least partially overlay the heat-reflecting surfaces of at least some of the plurality of heat-reflecting elements, the at least some of the plurality of spacer elements attached to and extending from the first side of the base material, but not penetrating through the base material, and from the heat-reflecting surfaces to be directed toward and exposed to contact by the wearer of the insulating material, each spacer element sized and shaped to reduce contact of the heat-reflecting elements with an underlying surface or with the wearer.

2. The insulating material of claim 1, wherein the spacer elements project from the first side of the base material about 0.2-2.0 mm.

3. The insulating material of claim 1, wherein each VOF element comprises a plurality of fibers oriented substantially perpendicular to a surface of the base material.

4. The insulating material of claim 3, wherein the fibers comprise nylon or polyester fibers.

5. The insulating material of claim 3, wherein the fibers comprise wicking fibers.

6. The insulating material of claim 3, wherein the fibers have an average linear density of 0.9-22 dtex.

7. The insulating material of claim 1, wherein the heat-reflecting elements comprise metal, metallized plastic or metallic foil.

8. The insulating material of claim 1, wherein a surface area ratio of heat-reflecting elements to base material is from 7:3 to 3:7.

9. The insulating material of claim 1, wherein a surface area ratio of heat-reflecting elements to base material is from 6:4 to 4:6.

10. The insulating material of claim 1, wherein at least a portion of the base material remains uncovered between adjacent heat-reflecting elements.

11. The insulating material of claim 1, wherein at least a portion of the base material remains uncovered between adjacent spacer elements.

12. The insulating material of claim 1, wherein at least a portion of the base material remains uncovered between adjacent heat-reflecting elements and between adjacent spacer elements.

13. The insulating material of claim 1, wherein the spacer elements prevent contact between the heat reflecting elements and the underlying surface.

14. The insulating material of claim 1, wherein the insulating material is part of a coat, jacket, shoe, boot, slipper, glove, mitten, hat, scarf, pants, sock, tent, backpack, or sleeping bag, shirt, pullover, or base layer.

15. The insulating material of claim 1, wherein the heat-reflecting elements have an emissivity of about 0.04 or less.

16. The insulating material of claim 1, wherein the heat-reflecting elements have an emissivity of 0.1 or less.

17. An insulating material comprising:

a base material having a moisture vapor transfer rate (MVTR) of at least 2000 g/m$^2$/24 h (JIS 1099 A1);

a plurality of heat-reflecting elements coupled to a first side of the base material, wherein the first side of the base material is an innermost surface of the base material, each heat-reflecting element having a heat-reflecting surface positioned to reflect heat towards a wearer of the insulating material; and a plurality of vertically oriented fiber (VOF) elements, wherein at least some of the plurality of VOF elements at least partially overlay the heat-reflecting surfaces of at least some of the plurality of heat-reflecting elements, the at least some of the plurality of VOF elements attached to and extending from the first side of the base material, but not penetrating through the base material, and from the heat-reflective surfaces to be directed toward and exposed to contact by the wearer of the insulating material, each VOF element comprising a plurality of fibers oriented substantially perpendicular to a surface of the base material;

wherein the fibers comprise polyester fibers having an average length of 0.3-1.0 mm and an average diameter of 5-10 dtex;

wherein the heat-reflecting elements comprise metallic plastic or metallic foil; and wherein at least a portion of the base material remains uncovered between adjacent heat-reflecting elements and between adjacent VOF elements.

* * * * *